United States Patent [19]

Göransson

[11] Patent Number: 4,671,808

[45] Date of Patent: Jun. 9, 1987

[54] ARRANGEMENT FOR SUPPORTING A PLURALITY OF DISCHARGE ELECTRODES, AND A DISCHARGE ELECTRODE SUITED TO THE ARRANGEMENT

[75] Inventor: Rolf Göransson, Växjö , Sweden

[73] Assignee: Fläkt AB, Nacka, Sweden

[21] Appl. No.: 794,526

[22] Filed: Nov. 4, 1985

[30] Foreign Application Priority Data

Nov. 5, 1984 [SE] Sweden ..... 8405541

[51] Int. Cl.[4] ..... B03C 3/76

[52] U.S. Cl. ..... 55/112; 55/113

[58] Field of Search ..... 55/13, 112, 113

[56] References Cited

U.S. PATENT DOCUMENTS

| | | | |
|---|---|---|---|
| 3,086,341 | 4/1963 | Brandt | 55/13 X |
| 3,219,130 | 11/1965 | Steuernagel et al. | 55/13 X |
| 3,553,939 | 1/1971 | Dyla | 55/140 X |
| 3,570,217 | 3/1971 | Steuernagel | 55/112 |
| 3,759,014 | 9/1973 | Van Dyken, II et al. | 55/13 X |
| 3,844,742 | 10/1974 | Petersen | 55/112 |
| 4,093,431 | 6/1978 | Frauenfelder | 55/112 |
| 4,353,718 | 10/1982 | Franzen et al. | 55/112 |
| 4,356,008 | 10/1982 | Franzen et al. | 55/112 |
| 4,412,850 | 11/1983 | Kurata et al. | 55/152 X |
| 4,502,870 | 3/1985 | Wheeler | 55/13 |
| 4,519,817 | 5/1985 | Gibbons | 55/112 |
| 4,521,229 | 6/1985 | Baker et al. | 55/152 X |
| 4,526,591 | 7/1985 | Getzin | 55/112 |

FOREIGN PATENT DOCUMENTS

| | | | |
|---|---|---|---|
| 1929224 | 1/1970 | Fed. Rep. of Germany . | |
| 946810 | 1/1964 | United Kingdom | 55/152 |
| 1100328 | 1/1968 | United Kingdom . | |
| 1226276 | 3/1971 | United Kingdom . | |

*Primary Examiner*—Robert Spitzer

*Attorney, Agent, or Firm*—Burns, Doane, Swecker & Mathis

[57] ABSTRACT

An electrode holding arrangement (11,12,13,14,15) forming part of an electrostatic percipitator and intended for supporting a plurality of discharge electrodes (2). In addition to the discharge electrodes (2) the precipitator also incorporates one or more collector electrodes (25), and a voltage source for supplying energy to the discharge and collector electrodes so as to create therebetween a high D.C. voltage which influences dust carried in a dust-laden medium passing between the discharge and collector electrodes in a manner to separate dust from the medium, this dust falling primarily on the collector electrodes. Respective discharge electrodes comprise a rod-like flexurily rigid member having attached thereto, or formed integrally therewith electrode parts which present discharge tips. A predetermined number of discharge electrodes (2) are attached at their upper end parts (*2a*) to a common, elongated, horizontallly extending electrode holding device (11). The electrode holding device (11) is arranged to co-act with a carrier element (12,13) via means (14,15,16) which permit horizontal, or substantially horizontal movement of the electrode holding device (11), this movement being effected with the aid of a percussion mechanism (17) arranged to deliver a horizontally directed imapct force to the electrode holding device (11).

12 Claims, 9 Drawing Figures

ARRANGEMENT FOR SUPPORTING A PLURALITY OF DISCHARGE ELECTRODES, AND A DISCHARGE ELECTRODE SUITED TO THE ARRANGEMENT

TECHNICAL FIELD

The present invention relates to a holding arrangement for supporting one or more discharge electrodes, and in particular to such an arrangement intended to form part of an electrostatic precipitator which, in addition to the discharge electrodes, also incorporates one or more collector electrodes and a voltage source from which energy is supplied to the discharge and collector electrodes so as to generate therebetween a high D.C., voltage which influences dust located between the discharge and collector electrodes and present in a dust-laden medium, in a manner to cause the majority of the extracted dust particles to settle on the collector electrodes. The respective discharge electrodes comprise a rod-like flexurily rigid member and electrode parts connected to the said member or formed integrally therewith and presenting discharge tips, a predetermined number of discharge electrodes being pivotally connected at their upper end portions to a common, elongated and horizontally extending holding device.

The invention also relates to a rigid discharge electrode adapted to co-operate with the aforesaid electrode carrying arrangement.

BACKGROUND PRIOR ART An electrode holding arrangement for supporting a plurality of discharge electrodes and being of the kind to which the present invention relates is previously known to the art. It is known, in this respect, to arrange in the electrostatic precipitator an upper frame construction to which the upper end parts of the discharge electrodes are connected. The frame construction is electrically insulated against the housing of the electrostatic precipitator, with the aid of non-conductive shafts, and non-conductive supports, so that the said construction is able to co-act through these insulating means with a percussion mechanism adapted to deliver to the frame construction as a whole, and therewith also the discharge electrodes connected thereto, impact energy with the impact force directed vertically and thus parallel with the centre lines of respective discharge electrodes.

With regard to the present state of the art in respect of discharge electrodes it is known to construct the electrodes from a rod-like element which is rigid and self-supporting and to which there is attached one or more electrode parts presenting discharge-electrode tips, these electrode parts being distributed along the rod-like element and extending transversely of the longitudinal extension thereof and beyond the outer defining surfaces of the element.

The discharge electrode described and illustrated in the British Patent Specification 1 100 328 is an example of prior art discharge electrodes.

DISCLOSURE OF THE PRESENT INVENTION

TECHNICAL PROBLEMS

With respect to the prior state of this art as expressed in the afore-mentioned multi discharge-electrode holding arrangement it is obvious that a qualified technical problem in this respect is one of providing such an electrode holding means in which impact energy delivered through a percussion mechanism can be distributed equally, or substantially equally to all discharge electrodes.

A further technical problem is one of providing means whereby the arrangement can be given a form such that impact energy delivered through a percussion mechanism will not concentrate on one or more dincharge electrodes attached in the immediate vicinity of the point of impact, but with which impact energy is uniformly distributed to all discharge electrodes attached to the electrode holding arrangement.

Another technical problem is one of constructing an electrode holding arrangement in which impact energy to all discharge electrodes can be distributed without being damped by suspension devices, despite the impact energy being transmitted to the discharge electrodes from above.

A further technical problem in electrode holding arrangements of the aforesaid kind is one of providing conditions which enable a simple means to be arranged between a holding device and a holder element such as to permit horizontal, or substantially horizontal movement of the holding device.

Still a further technical protlem associated with an electrode holding arrangement of this kind is one of providing means which enables the percussion mechanism to be attached in a ready and simple manner such that the holding device can be subjected to a horizontally directed impact, by arranging for a drop hammer to act on an anvil means attached to the electrode holding device when the hammer executes a horizontally directed impact movement.

A further technical problem in respect of electrode holding arrangements of this kind is to ensure that when respective discharge electrodes are pivotally connected at their upper ends to the holding device, which is imparted a horizontal movement upon impact, that the upper end part of each rod-like member of the discharge electrode is also imparted a corresponding horizontal movement, this movement migrating downwardly in the form of wave motion, thereby to shake loose dust connections, inter alia, on the electrode parts on the discharge electrodes, and the discharge tips of said electrode parts.

With respect to the present state of this art with regard to discharge electrodes, a prominent technical problem is one of enabling rigid discharge electrodes comprising electrode parts which form a plurality of discharge tips extending beyond the rod-like member to be manufactured in a ready and simple fashion. Each electrostatic precipitator incorporates a large number of discharge electrodes, normally extending in a row of up to 15 meters in length.

One particular technical problem in this respect is to be able to give respective discharge electrodes an external form which permits the electrodes to be transported while packed closely together, preferably in bundles, from a manufacturing site to an installation site.

It will readily be seen that a further technical problem is one of enabling the discharge electrode, together with associated electrode parts and discharge tips, to be given a form such that when a plurality of discharge electrodes are arranged close together and positioned horizontally for bundled transportation, the weight of mutually adjacent discharge electrodes will not bear on the discharge tips of associated further electrodes so as to drastically deform said discharge tips.

A further qualified technical problem in this particular art is one of providing conditions which, while taking into account a solution to the aforesaid technical problems, will enable discharge electrodes to be readily formed so as to provide in the electrostatic precipitator a uniform distribution of current combined with a low ignition voltage for a corona build-up and fulfil the desire of being able to construct double rows of discharge tips.

Still another technical problem is one of providing a flexurily rigid discharge electrode of such configuration that it not only affords a solution to the aforesaid technical problem, but also such that the upper end of the electrode can be readily assured a torsionally rigid attachment to an electrode holding device, without needing to take troublesome measures at the upper end of the discharge electrode.

A further technical problem connected with the provision of a flexurily rigid discharge electrode which affords a solution to the aforesaid technical problem is one of providing conditions such that the upper end of the discharge electrode can be readily attached to an electrode holding device without danger of angular error at the point of attachment, wherewith the attachment can be made so that respective discharge electrodes among a plurality of electrodes forming an electrode row do not only obtain a precise relationship with adjacent collector electrodes but that the discharge tips of the discharge electrodes are also given a pre-determined alignment in relation to the collector electrodes.

A further technical problem is one of providing a rigid discharge electrode which not only affords a solution to the aforesaid technical problem but which is also of such simple configuration that the discharge electrodes can be manufactured substantially without the use of jigs or like devices, and in all event without requiring the use of complicated machines.

Finally, it will be seen that another technical problem is one of providing a discharge electrode in which the coaction between the rod-like member and the electrode parts is of such a nature that impact forces acting on the discharge electrode, in order to remove dust collected thereon, are also effectively distributed to all discharge tips.

SOLUTION As a solution to the aforementioned technical problems, the present invention relates to an electrode holding arrangement intended to carry a plurality of discharge electrodes and intended for use in an electrostatic precipitator. This electrostatic precipitator also incorporates one or more collector electrodes, in addition to the aforementioned discharge electrode. The electrostatic precipitator also includes a voltage source for supplying energy to the discharge and collector electrodes, so as to create a high D.C. voltage between said electrodes. This D.C. voltage is intended to act on dust present in a dust-laden medium and located between the discharge and collector electrodes, so that dust is extracted and collected primarily on the collector electrodes.

Respective discharge electrodes comprise a rod-like flexurily rigid member to which there is attached electrode parts or components having discharge electrode tops formed thereon.

A pre-determined number of discharge electrodes arranged in rows are preferably pivotally mounted at their upper end parts to a common, elongated and horizontally extending electrode holding device.

In accordance with the invention an electrode holding device intended for the aforesaid use is preferably arranged to co-act with at least one holder or carrier element through one or more means enabling the electrode holding device to move horizontally, or substantially horizontally, for example in a slight pendulating movement.

According to one advantageous embodiment of the invention the percussion mechanism incorporates a drop hammer which is attached to the carrier element and delivers a horizontally directed hammer blow against an anvil means mounted on the electrode holder device, so as to impart a horizontally directed impact thereto.

The electrode holding device conveniently comprises a flexurily rigid beam attached to the carrier element via one or more, preferably two, thin plates which function as spring means.

Respective discharge electrodes are pivotally connected at their upper end parts to the electrode holding device in a manner such that when the device is subjected to an impact force and moves horizontally a corresponding horizontal movement is imparted to the upper end part of the rod-like member of each discharge electrode, this horizontal movement having the form of wave motion which migrates downwardly along the rod-like member of the discharge electrode, such as to horizontally shake loose dust collections on, inter alia, the electrode parts of the discharge electrodes and the discharge tips of said electrode parts.

In accordance with another advantageous embodiment of the invention the electrode holding device is constructed so that the impact energy generated by the percussion mechanism can be transmitted equally or substantially equally to all discharge electrodes attached to the electrode holding device.

The present invention also relates to a rigid discharge electrode intended for use in electrostatic precipitators and arranged to co-act with an electrode holding device forming part of an electrode holding arrangement. Such electrostatic precipitators also incorporate one or more collector electrodes in addition to the aforesaid one or more discharge electrodes, with both types of electrodes positioned vertically, and are also provided with a voltage source for supplying energy to both the discharge and the collector electrodes so as to create therebetween a high D.C. voltage. The D.C. voltage creates an electrostatic field between the electrodes, so that dust contained in a dust-laden medium therebetween is extracted from said medium and rests primarily on the collector electrodes.

The present invention has for its starting point a rigid discharge electrode having the form of a rod-like self-supporting member to which there is attached a plurality of electrode parts which form one or more discharge electrode tips and which extend along the rod-like member transversely to its longitudinal extension and extending beyond the outer defining surfaces of said member.

In accordance with one embodiment of the invention the rod-like member presents at least two mutually parallel and mutually opposite, preferably planar surfaces, and the elongated electrode parts having discharge tips formed thereon are attached to two mutually opposite and mutually parallel surfaces.

The rod-like self-supporting member is preferably of right-angled cross-section, preferably square cross-section, and is produced from a standard hollow profile, and the electrode parts attached to the planar surfaces have a length corresponding, or substantially corresponding to three times the extension of said member in a plane common to the electrode parts. The electrode parts are advantageously attached to the rod-like member so as to be inclined relative to a centre line on the rod-like member.

In accordance with a further embodiment of the invention a first plurality of electrode parts are mounted on the one planar surface and displaced along the rod-like member in relation to a second plurality of electrodes attached to the other surface located parallel with the first-mentioned planar surface. The one end part of the one planar surface is arranged to face towards a holding device, so as to hold and position on the discharge electrode between the collector electrodes. One end part of a securing element constructed for clamping action is arranged to rest against the electrode holding device. The securing element is arranged to extend through the two planar surfaces. In addition, one end part of a sleeve is arranged to pass the planar surface facing the electrode holding device, whereas the other end part of the sleeve serves as a support for the planar surface facing away from said device. The other end part of the securing element co-acts with a clamping means.

The securing element conveniently consists of a bolt and the clamping means of a nut, wherein the holding device and the planar surface facing away therefrom are each provided with a respective hole which is somewhat larger than the cross-sectional size of the bolt, while the planar surface facing towards the device is provided with a hole which is slightly larger than the outer cross-sectional size of the sleeve.

ADVANTAGES

Those advantages primarily afforded by an electrode arrangement for carrying a plurality of discharge electrodes in accordance with the present invention reside in the provision of means whereby the impact energy delivered by a percussion mechanism is distributed equally to all discharge electrodes attached to the electrode holding device associated with the electrode holding arrangement, by arranging for the holding device to co-act with one or more carrier elements by means of which the holding device can move horizontally or substantially horizontally in relation to the carrier element through the agency of means herefor.

Those advantages primarily afforded by a rigid discharge electrode in accordance with the present invention reside in the external configuration of the discharge electrode, enabling a plurality of such electrodes to be readily stacked together in the form of a bundle without drastically deforming the electrode discharge tips formed on electrode parts, in combination with the fact that the discharge electrode can be readily attached to a holding device in a torsionally rigid manner. In addition hereto, the discharge electrode is such as to enable it to be manufactured without the use of complicated auxiliary tools and machines.

The primary characteristic features of an electrode holding arrangement for carrying a plurality of discharge electrodes in accordance with the present invention are set forth in the characterizing clause of the following claim 1, whereas the primary characterizing features of a rigid discharge electrode according to the invention are set forth in the characterizing clause of the following claim 10.

BRIEF DESCRIPTION OF THE DRAWINGS

A preferred embodiment exhibiting characterizing features significant of the present invention will now be described in more detail with reference to the accompanying drawings, in which.

DESCRIPTION OF A PREFERRED EMBODIMENT

Figure 1:
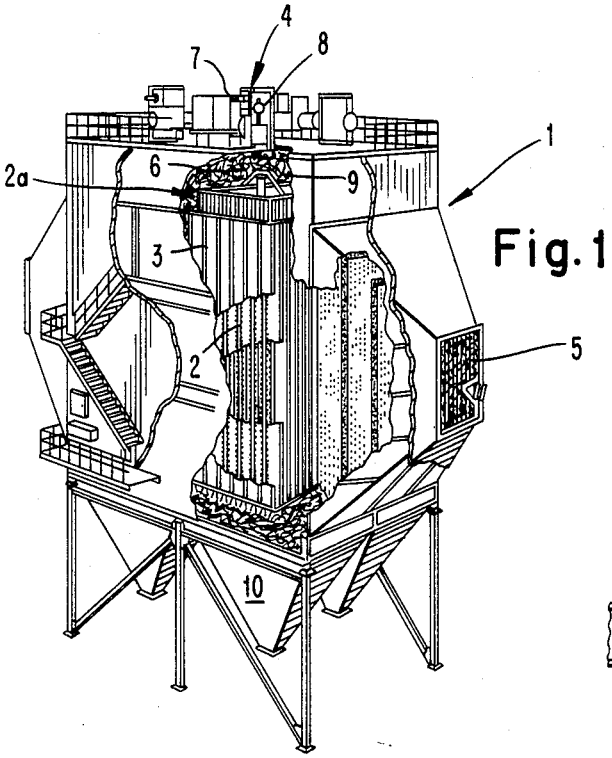
FIG. 1 is a perspective view of a prior art electrostatic precipitator incorporating an electrode holding arrangement for supporting a plurality of discharge electrodes, the electrode holding arrangement co-acting with a percussion mechanism for generating impact energy which is capable of being transmitted to the discharge electrodes so as to vibrate the same, so that collections of dust, inter alia on the electrode parts of the discharge electrodes and the dlscharge tips provided on said electrode parts are shaken loose.

FIG. 1 illustrates in perspective a known electrostatic precipitator provided with electrode holding means for supporting a plurality of discharge electrodes. The precipitator is referenced 1 and incorporates, in addition to the aforesaid discharge electrodes 2, also a plurality of collector electrodes 3. The discharge electrodes 2 and the collector electrodes 3 form mutually parallel planes which are displaced relative to one another, and a voltage source (not shown) is provided through which energy is supplied to the electrodes via a connection 4, so as to create an electrostatic field between the electrode planes.

This field acts on dust suspended in a dust-laden medium passing between the collector and discharge electrodes and entering through an inlet 5, and causes the dust to separate from the medium and settle primarily on the collector electrodes 3.

Respective discharge electrodes comprise a rod-like, flexurily rigid element to which there are attached, or formed integrally therewith electrode parts having discharge electrode tips, wherewith a pre-determined number of discharge electrodes are attached in the region of their upper ends 2*a* to a common elongated and horizontally arranged electrode holding device. A plurality of such devices form an upper frame structure 6. This upper frame structure 6 co-acts with a percussion mechanism 7, which is electrically insulated from the filter housing of the precipitator with the aid non-conducting shafts and non-conducting supports 8.

The percussion device 7 is constructed to deliver a vertically directed impact force to the upper frame construction 6 through a shaft 9, causing a11 vertically arranged discharge electrodes 2 to vibrate in the direction of the longitudinal axis, thereby causing dust collected on the electrode parts and the discharge electrode tips thereon to loosen and fall into a dust-collecting bunker 10.

A percussion mechanism is also arranged in the lower part of the filter 1, for corresponding co-action with the collector electrodes 3.

Figure 2:
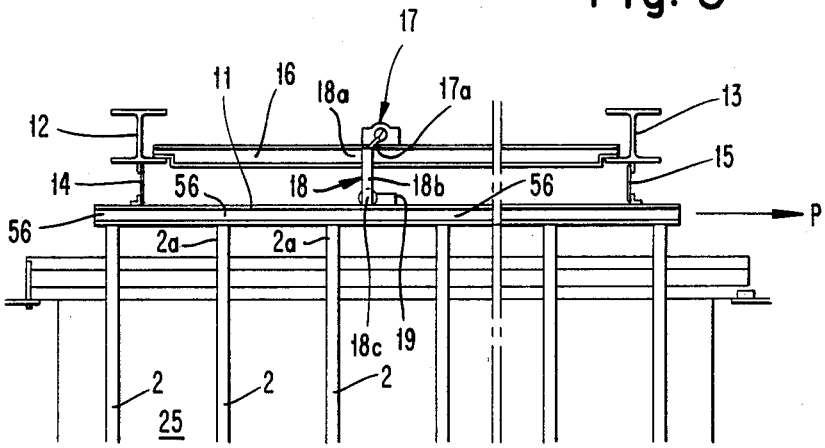
FIG. 2 is a side view, at rlght angles to the flow direction of the gas, of an electrode holding arrangement according to the invention, with associated percussion mechanism.

FIG. 2 illustrates an electrode holding means for supporting a plurality of mutually identical discharge electrodes. A pre-determined number of these electrodes are pivotally mounted at their respective upper ends 2*a* to a common, elongated, horizontally positioned electrode holding device 11 in the form of a flexurily rigid U-beam. The electrode holding device is arranged to co-act with one or more holder or carrier elements in the form of I-beams, of which two are shown at 12 and 13 in the illustrated embodiment and which extend at right angles to the electrode holding device 11. The illustrated embodiment also includes one or more, in this case two, means 14,15 for permitting movement of the electrode holding device 11 in a horizontal or substantially horizontal direction.

The horizontal movement to which reference is made here constitutes a slight pendulating movement, and the means 14,15 are also intended to function as spring means, such that when swinging horizontally in one direction the electrode holding device 11 will swing back to the position shown in FIG. 2. Extending between the carrier or holding elements 12 and 13 is an I-beam 16, which can be considered to form part of one electrode carrier element.

The beam 16 is placed centrally between two mutually parallel and mutually connected electrode holding devices 11,11', so as to enable the percussion mechanism 17 to act on two (double) or more rows of discharge electrodes through an anvil means 19 common thereto.

The percussion mechanism 17 comprises a drop hammer 18 and is intended to deliver a horizontally directed impact force to the electrode holding device 11 (11') as shown in FIG. 2. The percussion mechanism 17 and the drop hammer 18 are attached to the beam 16 of the electrode holding device and are oriented to deliver a hammer impact to an anvil means 19 mounted on the electrode holding device 11. The drop hammer 18 is lifted out of contact with the anvil means 19 with the aid of an arm 17*a*, which rotates anti-clock wise in the FIG. 2 illustration, and is swung about its rotation axis 18*a* with the aid of said arm 17*a*. When the arm 17*a*again takes the position illustrated in FIG. 2, an arm 18*b* is able to swing down from an upper position and, through the agency of a weight 18*c*, transmit a percussion or impact force to the holding device 11 in the direction of the arrow "P", through the anvil means 19.

The holding device 11 has the form of a flexurily rigid beam which is connected to two carrier elements 12,13 through two thin plates 14,15. When only one such plate is used, one or more supports are required to prevent the ends of the electrode holding device 11 from twisting; in the illustrated embodiment two such plates are provided and consequently no such supports are required in this case.

Respective discharge electrodes 2 are pivotally connected at their end portions 2*a* to the electrode holding device 11 which, as a result of the impact force delivered through the percussion mechanism 17, is imparted a horizontally active acceleration force in the direction of the arrow "P", a similar horizontally acting acceleration force being therewith imparted to the upper end portion 2*a* of the rod-like member of each discharge electrode. Because of the flexural rigidity of the beam, all discharge electrodes 2 will be influenced uniformly. This horizontal acceleration force to which the upper end parts 2*a* are subjected migrates downwardly along the discharge electrodes in the form of an undulating movement, and upon the occurrence of such wave-motion , with the amplitude directed horizontally, dust collected, inter alia, on the electrode parts of the discharge electrodes, and on the discharge electrode tips (not shown) on the said electrode parts, will be shaken therefrom.

Due to the flexural rigidity of the electrode holding device 11, the impact energy generated by the percussion mechanism can be transferred uniformly, or substantially uniformly to all discharge electrodes attached to the electrode holding device 11.

Figure 3:
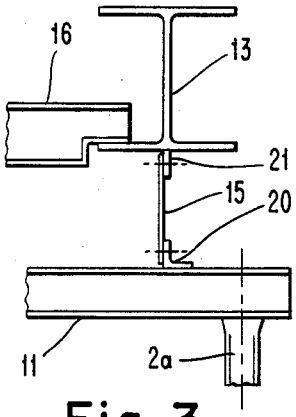
FIG. 3 illustrates in a somewhat larger scale than FIG. 2 how an electrode holding device co-acts with a carrier element through means herefor, enabling horizontal or substantially horizontal movement of the electrode holding device.

As illustrated in the enlarged view in FIG. 3, the plate 15 is connected at one end thereof to the electrode holding device 11 by means of an L-shaped beam 20, and at the other end thereof to the carrier or holding element 13, having the form of a I-beam, by means of an attachment means 21.

Figure 4:
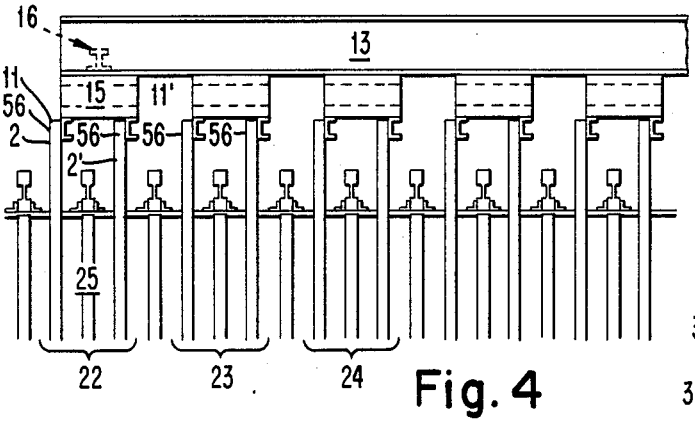
FIG. 4 is a front view, parallel with the flow direction of the gas, of the electrode holding device according to the invention and illustrated in FIG. 2.

FIG. 4 illustrates two rows cf mutually identical discharge electrodes, where the rows of electrodes are held firmly by one and the same thin plate 15, via two mutually parallel electrode holding devices 11,11'.

FIG. 4 also shows that a plurality of such groups of discharge electrodes can be arranged along the carrier element or beam 13, and it is suggested that different percussion mechanisms, one for each of the groups 22,23 and 24, are arranged and synchronised so that the horizontally directed impact forces delivered by the percussion mechanisms are out of time-phase with one another.

Figure 5:
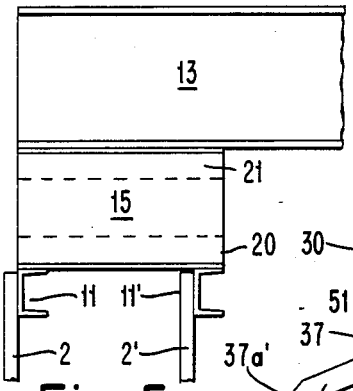
FIG. 5 illustrates in a slightly larger scale than FIG. 4 how the electrode holding device co-acts with a carrier element via means herefor, so as to enable horizontal or substantially horizontal movement of the electrode holding device and the firm attachment of the discharge electrode to the electrode holding device.

The enlarged view of the FIG. 5 illustration shows the attachment of the thin plate 15 to the beam 13 and the co-action of the electrode holding devices 11,11' with the plate 15 and the discharge electrodes 2,2'.

If it is assumed that the distance between the centre lines of the discharge electrodes 2,2' is 300 mm, the collector electrodes 25 shall be centered between said discharge electrodes according to FIG. 4. In this case, the thin plate 15 preferably comprises a 3 mm steel plate, which when subjected to impact energy through the anvil means 19 is sprung away with minor losses and rapidly returns the electrode holding device 11 and 11' to the position illustrated in FIG. 2.

Figure 6:
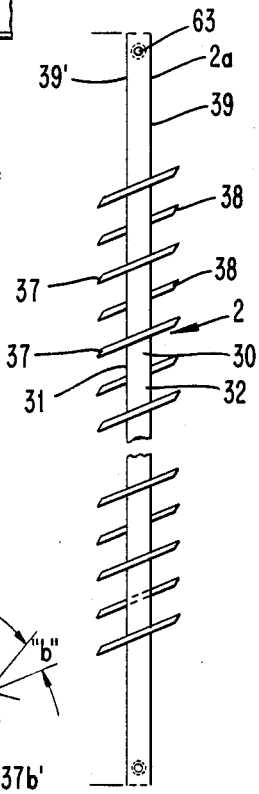
FIG. 6 is a side view of a rigid discharge electrode in accordance with the present invention.

FIG. 6 is a side view of a rigid discharge electrode 2 according to the present invention, said electrode comprising a rod-like member 30. Attached to the rod-like member 30 are electrode parts 37, 38 which are distributed along the member 30 and extend transversely to the longitudinal extension thereof beyond the outer defining surfaces 31,32 of said member. A first number of electrode parts 37 are attached to one defining surface 39 and a further number of electrode parts 38 are attached to an opposite defining surface 39'.

The rod-like member 30 is provided with at least two, mutually opposite and mutually parallel planar surfaces, either the surfaces 39 and 39' or the surface 31,32, such that the elongated electrode parts 37,38 can be attached to mutually opposite planar surfaces.

Figure 8:
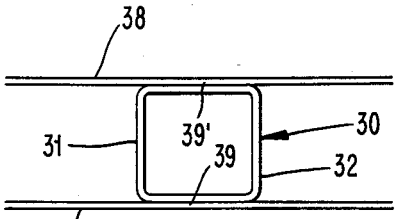
FIG. 8 is a horizontal sectional view in somewhat larger scale of the discharge electrode illustrated in FIG. 6.

In accordance with the invention, the elongated member 30 has a right-angled cross-sectional shape, preferably a square cross-section, thereby presenting the aforesaid two mutually opposed parallel planar surfaces 39, 39' to which electrode parts 37,38 are attached, and in addition two plane-parallel, mutually opposite defining surfaces 31,32 facing towards and away from the direction of flow of the medium, as shown more clearly in FIG. 8.

Figure 7:
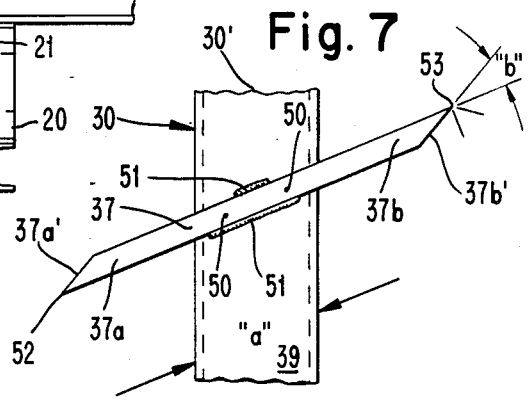
FIG. 7 is a side view of part of the discharge electrode illustrated in FIG. 6, this view illustrating more clearly the orientation of respective electrode parts in relation to a rod-shaped member.

The somewhat enlarged view shcwn in FIG. 7 illustrates part of the elongated member 30 to which an electrode part 37 has been attached. This electrode part 37 can be attached to the planar surface 39 by means of spot welds 50 or by means of one or two weld beads 51,51'. The length of the electrode part 37 corresponds to three times the extension of the member 30 in a plane allotted to the electrode, namely the distance "a". The electrode part 37 may also be mounted on the member 30 so as to be inclined in relation to a centre line 30' of the member 30. The electrode part may also be positioned perpendicularly.

The extent to which the electrode part is inclined to said centre line is dependent on two factors. Firstly, there must be achieved a pre-determined electrode tip distribution, in order to obtain satisfactory current distribution. And secondly in the case of similarly positioned electrode parts, for mutually adjacently positioned discharge electrodes packeted in a bundle during transportation the electrode parts shall be oriented adjacent one another, preferably with a given spacing between similarly positioned upper parts.

The electrode part 37 comprises material of right-angled cross-section, preferably rectangular cross-section, which is cut obliquely at its end parts **37*a*, 37*b* to form respective discharge tips 52 and 53 on an electrode part. The angle "b" of the discharge tip should be between 20° and 40°, preferably about 30°. It will be readily seen that each electrode part 37 can be clipped from strip material, so that the surface of the cut forms the surfaces 37*a'* and 37*b'*** of two different electrode parts.

Referring again to FIG. 6, it will be seen that a first number of electrode parts 37 are attached to the one planar surface, 39, and a second number of electrode parts 38 are attached to the opposite planar surface 39', and that each electrode part 37 is displaced relative to each electrode part 38. The electrode parts are displaced so that the electrode part 38 lies centrally between two electrode parts 37.

This arrangement is chosen so that a plurality of discharge electrodes can be bundled together for transportation, such that one surface 32 on the elongated member 30 will lie immediately adjacent one surface 31 of an adjacently lying discharge electrode, and the illustrated electrode parts 37 and 38 will be located on a respective side of the surface corresponding to the surfaces 39,39' of the further discharge electrode. The electrode parts of the further discharge electrode are, in a similar manner, located adjacent a respective side 39,39' of the discharge electrode illustrated in FIG. 6. As a result of this arrangement it is possible to pack a number of discharge electrodes tightly together and transport the same in bundle form without risking damage to the discharge tips of the electrode parts. The outermost discharge tips of the electrodes may be protected by placing a rectangular wooden batten or the like against the surface 32, the width of the batten being greater than the distance of the discharge tips to the surface 32.

Figure 9:
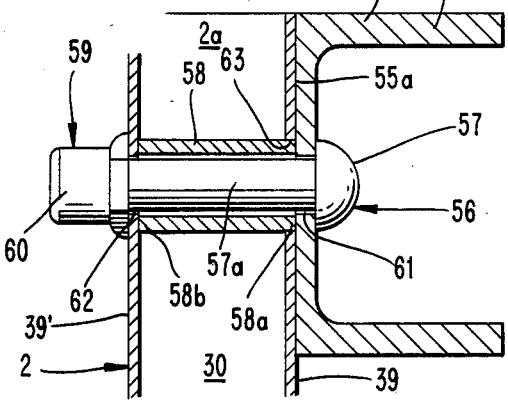
FIG. 9 is a side view, partially in section, of a securing element for securing a discharge electrode to an electrode holding device with a clamping action.

FIG. 9 illustrates that the one end part, the upper part **2*a* of the discharge electrode 2, of the one planar surface 39 is arranged to face a carrier or holding device 55, in the form of a U-beam, for holding and positioning the elongated member 30 of the discharge electrode between collector electrodes, said elongated member being held rigid against torsional forces and without risk of angular error at the point of attachment. The device 55 is identical to the devices 11 or 11' illustrated in FIG. 4**.

FIG. 9 also illustrates a securing means 56 which has a clamping action and which is arranged to rest at one end part 57 thereof against the planar surface **55*a* of the device 55. The securing means 56 extends through the two planar surfaces 39,39' and a sleeve 58 is arranged so that one end part 58*a* thereof passes through the planar surface 39 facing towards the device 55, while the other end part 58*b* of the sleeve 58 serves as a support for the planar surface 39' facing away from the device 55. The other end part 59 of the securing means 56 co-acts with a clamping means 60**.

The securing means 56 has the form of a bolt 57, whereas the clamping means 60 has the form of a nut. A hole 61 is provided in the device 55 and a hole 62 is provided in the planar surface 39' facing away from the device 55, these holes being slightly larger than the diameter **57*a* of the bolt 57. The planar surface 39 facing towards the device 55 has provided therein a hole 63 which is slightly greater than the outer cross-section 58*a*of the sleeve 58** at its end portion.

The invention is not restricted to the aforedescribed exemplifying embodiments, and modifications can be made within the scope of the following claims.

I claim:

1. An electrode holding arrangement in an electrostatic precipitator, comprising:

discharge electrodes having a rod-like flexurily rigid member and upper end parts;

electrode parts attached to said discharge electrodes;

discharge electrode tips on said electrode parts;

two horizontally extending electrode holding devices;

a predetermined number of said discharge electrodes attached at their upper end parts to said electrode holding devices;

a carrier element;

means for supporting said electrode holding devices by said carrier element while permitting relative and substantially horizontal movement between the carrier element and the electrode holding devices; and means mounted on the carrier element for delivering a substantially horizontally directed impact force to the electrode holding devices;

wherein there are two rows of electrodes arranged adjacent to each other and connected to the two electrode holding devices and that said electrode holding devices are actuated by one force delivering means arranged between the two holding devices.

2. The electrode holding arrangement according to claim 1, wherein each of the electrode holding devices has a form such that impact energy generated by the impact force delivering means is transmitted substantially equally to all discharge electrodes attached to the electrode holding device.

3. The electrode holding arrangement according to claim 1, wherein each of the rod-like members has arranged thereon two mutually opposed and mutually parallel surfaces; and the electrode parts presenting discharge tips are attached to said surfaces on said rod-like members.

4. The electrode holding arrangement according to claim 1, wherein each of the electrode holding devices comprises a flexurily rigid beam attached to the carrier element through two thin plates.

5. The electrode holding arrangement according to claim 1, wherein the electrode parts are inclined to a center line in the rod-like member.

6. The electrode holding arrangement according to claim 1, wherein each of the electrode holding devices comprises a flexurily rigid beam attached to the carrier element through one thin plate.

7. The electrode holding arrangement according to claim 1, wherein the respective discharge electrodes are pivotably connected at their upper end part to one of the electrode holding devices which upon moving horizontally as the result of impact force transmits to the upper end part of the rod-like member of each discharge electrode a horizontal movement which migrates downwardly in the form of a wave motion and shakes loose dust collection on the electrode part of the discharge electrodes and the discharge electrode tips thereof.

8. The electrode holding arrangement according to claim 1, wherein each of the electrode holding devices has a form such that impact energy generated by the impact delivering means is transmitted substantially equally to all discharge electrodes attached to the electrode holding device.

9. The electrode holding arrangement according to claim 1, wherein a planar surface for one discharge electrode is arranged at its upper end part to face a holding device for holding and positioning the discharge electrode between collector electrodes.

10. The electrode holding arrangement according to claim 1, wherein a securing means constructed for clamping action is arranged to rest at one end thereof against one of the electrode holding devices; the securing means extends through two planar surfaces of the upper end part of the discharge electrode; one end part of a sleeve is arranged to pass through the planar surface facing the electrode holding device, whereas the other end part of the sleeve serves as a support for the planar surface facing away from the electrode holding device; and the other end part of the securing means coacts with a clamping means.

11. The electrode holding arrangement according to claim 1, wherein the rod-like flexurily rigid member has a square cross section, and is formed from a hollow profile.

12. The electrode holding arrangement according to claim 1, wherein the length of respective electrode parts corresponds to three times the length of the rod-like member along the electrode part.

* * * * *